US009208709B2

(12) United States Patent
Merz

(10) Patent No.: US 9,208,709 B2
(45) Date of Patent: Dec. 8, 2015

(54) BACKLIGHT FOR A DISPLAY

(75) Inventor: Nicholas George Merz, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 1389 days.

(21) Appl. No.: 12/774,139

(22) Filed: May 5, 2010

(65) Prior Publication Data

US 2011/0273377 A1 Nov. 10, 2011

(51) Int. Cl.

| | |
|---|---|
| ***G09G 3/36*** | (2006.01) |
| ***G09G 3/20*** | (2006.01) |
| ***G09G 5/00*** | (2006.01) |

(52) U.S. Cl.

CPC ..... *G09G 3/20* (2013.01); *G09G 3/2092* (2013.01); *G09G 5/003* (2013.01); *G09G 3/3648* (2013.01)

(58) Field of Classification Search

CPC ..... G09G 3/20; G09G 3/2092; G09G 3/3648; G09G 5/003

USPC ..... 345/173, 76, 102

See application file for complete search history.

(56) References Cited

U.S. PATENT DOCUMENTS

| | | | | |
|---|---|---|---|---|
| 5,965,907 | A | 10/1999 | Huang et al. | |
| 6,608,614 | B1 | 8/2003 | Johnson | |
| 6,900,458 | B2 | 5/2005 | Tung et al. | |
| 6,923,548 | B2 | 8/2005 | Lim | |
| 6,987,547 | B2 | 1/2006 | Yang et al. | |
| 7,389,432 | B2 | 6/2008 | Chandley et al. | |
| 7,441,935 | B2 | 10/2008 | Kim | |
| 7,619,604 | B2 | 11/2009 | Karman et al. | |
| 7,637,648 | B2 | 12/2009 | Jung et al. | |
| 7,649,593 | B2 | 1/2010 | Yoon et al. | |
| 2002/0196402 | A1 * | 12/2002 | Sanford et al. | 349/158 |
| 2005/0007517 | A1 * | 1/2005 | Anandan | 349/69 |
| 2006/0109397 | A1 | 5/2006 | Anandan | |
| 2006/0209006 | A1 | 9/2006 | Eckhardt | |
| 2006/0244879 | A1 | 11/2006 | Yoon et al. | |
| 2007/0035706 | A1 * | 2/2007 | Margulis | 353/122 |
| 2008/0055265 | A1 * | 3/2008 | Bewley et al. | 345/173 |
| 2008/0062148 | A1 * | 3/2008 | Hotelling et al. | 345/174 |
| 2008/0137008 | A1 | 6/2008 | Rogojevic et al. | |
| 2008/0150879 | A1 | 6/2008 | Kang | |
| 2009/0051637 | A1 | 2/2009 | Chen et al. | |
| 2009/0135108 | A1 * | 5/2009 | Lindfors et al. | 345/76 |
| 2009/0278867 | A1 | 11/2009 | Brown et al. | |

(Continued)

FOREIGN PATENT DOCUMENTS

| | | |
|---|---|---|
| WO | 2005/010595 A1 | 2/2005 |

*Primary Examiner* — Quan-Zhen Wang
*Assistant Examiner* — Tony Davis
(74) *Attorney, Agent, or Firm* — Fletcher Yoder PC

(57) ABSTRACT

Systems and devices are provided for using an organic light emitting diode (OLED) as a backlight for a liquid crystal display (LCD) device. In one embodiment, an OLED backlight may include one or more OLED elements disposed between two substrates. The OLED backlight may be optically bonded to the back of an LCD, and may further be electrically connected with the LCD active matrix. In one embodiment, information transmitted to selected pixels of the LCD active matrix may also be used by elements of the OLED backlight which are electrically connected to the selected LCD pixels. For example, the OLED backlight may respond to grayscale information transmitted to selected LCD pixels by emitting a corresponding intensity of light. In some embodiments, the LCD device may include other functions, such as touch sensing capabilities, which may be integrated with the LCD and OLED backlight.

23 Claims, 7 Drawing Sheets

(56) References Cited

U.S. PATENT DOCUMENTS

2009/0310065 A1 12/2009 Dunn
2010/0073276 A1* 3/2010 Koike et al. ..... 345/102
2010/0103089 A1* 4/2010 Yoshida et al. ..... 345/102
2010/0103353 A1* 4/2010 Yamada ..... 349/96
2010/0141871 A1* 6/2010 Hsu et al. ..... 349/68
2010/0171900 A1* 7/2010 Lee ..... 349/58
2011/0200293 A1* 8/2011 Zhang et al. ..... 385/131

* cited by examiner

BACKLIGHT FOR A DISPLAY

BACKGROUND

The present disclosure relates generally to displays for use in electronic devices and, more particularly, to liquid crystal display devices using organic light emitting diodes as a backlight.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including such consumer electronics as televisions, computers, and handheld devices (e.g., cellular telephones, portable media players, gaming systems, and so forth). Such LCD devices typically provide a flat display in a relatively thin package that is suitable for use in a variety of electronic goods. In addition, such LCD devices typically use less power than comparable display technologies, making them suitable for use in battery powered devices or in other contexts where it is desirable to minimize power usage.

LCD devices generally include a light source, as liquid crystal materials themselves do not emit light. A typical light source, also referred to as a backlight, may include light sources along one or more edges which emit light into light guide panels (LGPs) which guide the light across the display area. To increase the uniformity and brightness over the display area, a typical LCD device may also include brightness enhancement film (BEF) layers which reflect and enhance the light. However, such efforts to increase uniformity and/or brightness may also increase the thickness and complexity of the backlight and the LCD device. Furthermore, the different films and parts of an LCD having a LED backlight may be susceptible to contamination.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to a liquid crystal display (LCD) device having an organic light emitting diode (OLED) backlight. In one embodiment, an OLED backlight may include one or more OLED pixels disposed between two glass substrates. The OLED backlight may be optically bonded to the back of an LCD, which may prevent contamination between the LCD and the OLED backlight and increase the mechanical rigidity of the display device. Further, the OLED backlight may also be electrically connected with light modulating portions of the LCD, such that information transmitted to selected pixels of the LCD active matrix may also be transmitted to areas of the OLED backlight electrically connected to the selected LCD pixels. For example, grayscale information transmitted to selected LCD pixels may also be received by corresponding areas of the OLED backlight.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The application is generally directed to implementing one or more organic light emitting diode (OLED) elements as a backlight in a liquid crystal display (LCD) device. In some embodiments, an OLED backlight may include one or more OLED elements bonded between two glass pieces. The OLED backlight may be optically bonded to the back of light modulating layers of the LCD, which may prevent and/or reduce possible contamination between layers of the LCD and the OLED backlight. The bonding of the OLED backlight in the LCD may also increase the mechanical rigidity of the LCD, which may enable the use of thinner glass substrates and possibly reduce the thickness of the overall device. Further, an OLED backlight may generally be thinner than a typical LED backlight, and may also provide improved light uniformity without the use of light guides or additional brightness enhancing films.

In one embodiment, OLED elements of the OLED backlight may be electrically connected within the LCD, such that a signal may be selectively transmitted to pixels of the LCD and corresponding OLED elements of the backlight. For example, grayscale information transmitted to selected pixels of the LCD active matrix may also be received by individual OLED elements, such that the OLED elements may emit light at an intensity complementing or corresponding to the desired light transmission characteristics of the selected LCD pixels. In some embodiments, the LCD device with OLED backlight may also have other integrated features, such as wear balancing schemes for OLED elements, image calibration for the LCD active matrix, and/or touch sensing capabilities, as will be discussed.

Figure 1:
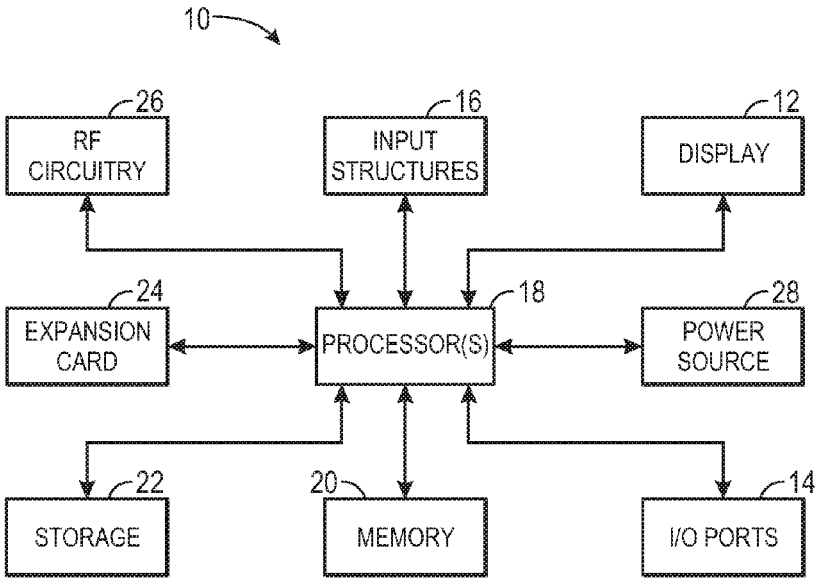
FIG. 1 is a block diagram of exemplary components of an electronic device that includes a display device, in accordance with aspects of the present disclosure.
Figure 2:
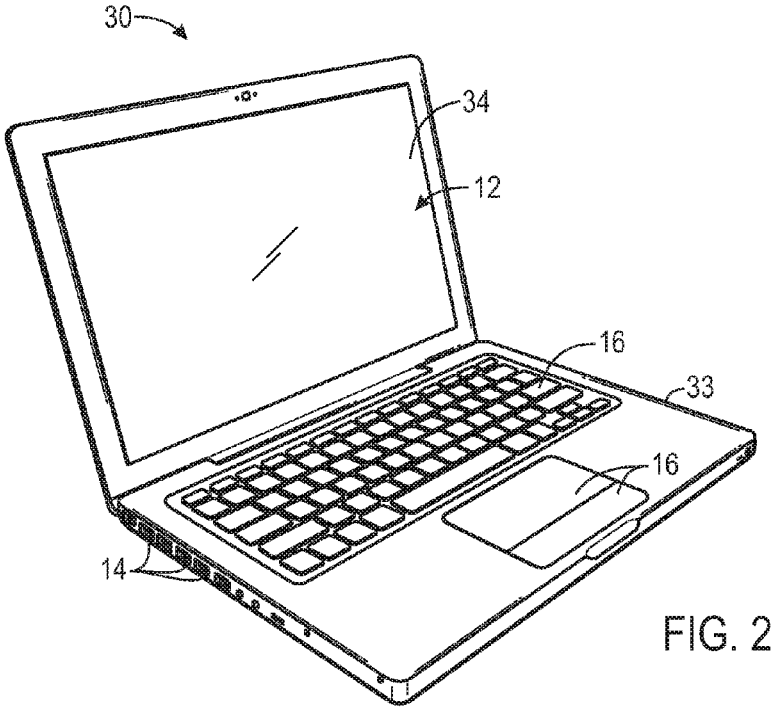
FIG. 2 is a perspective view of an electronic device in the form of a computer, in accordance with aspects of the present disclosure.
Figure 3:
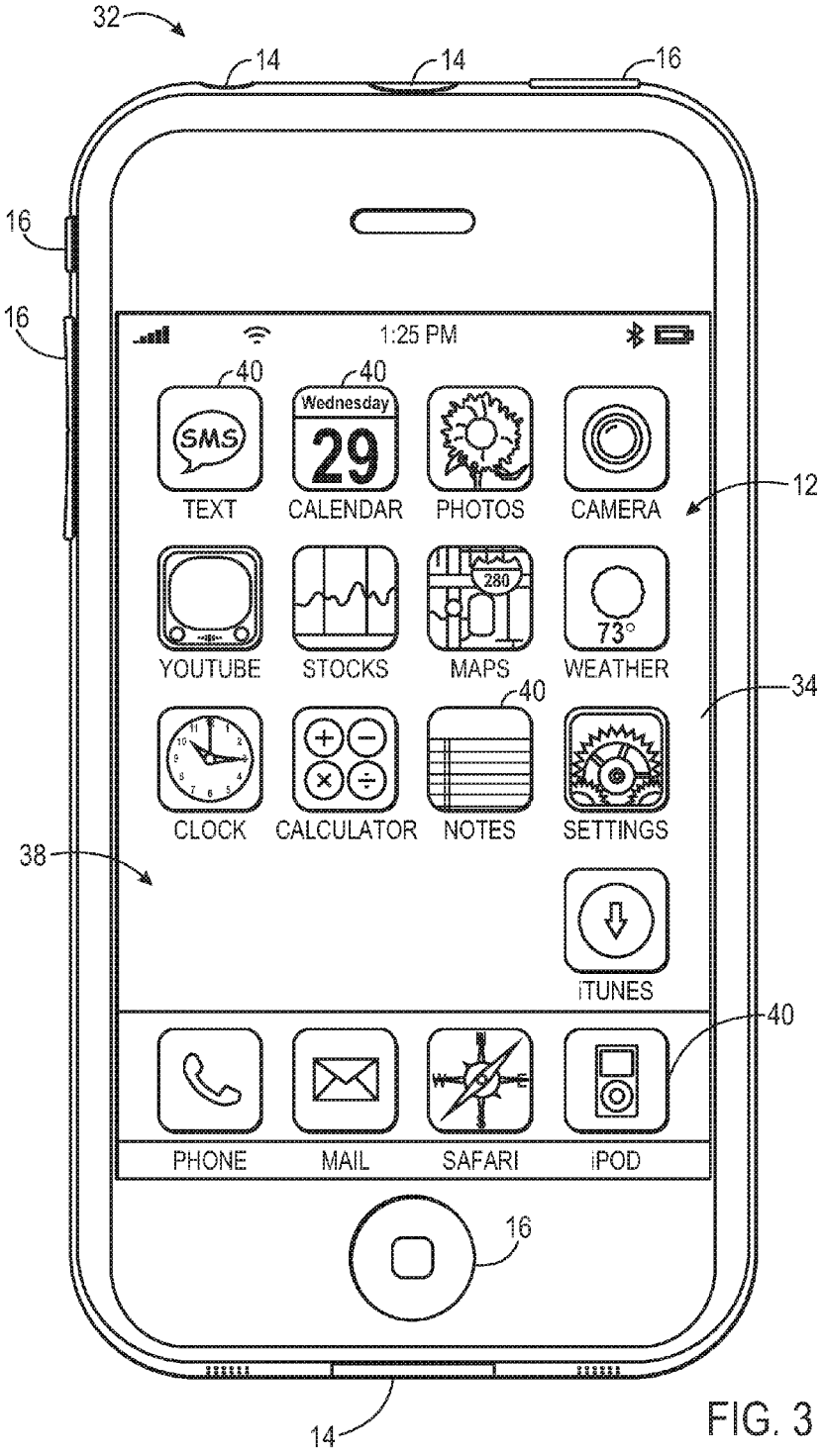
FIG. 3 is a front-view of a portable handheld electronic device, in accordance with aspects of the present disclosure.
Figure 4:
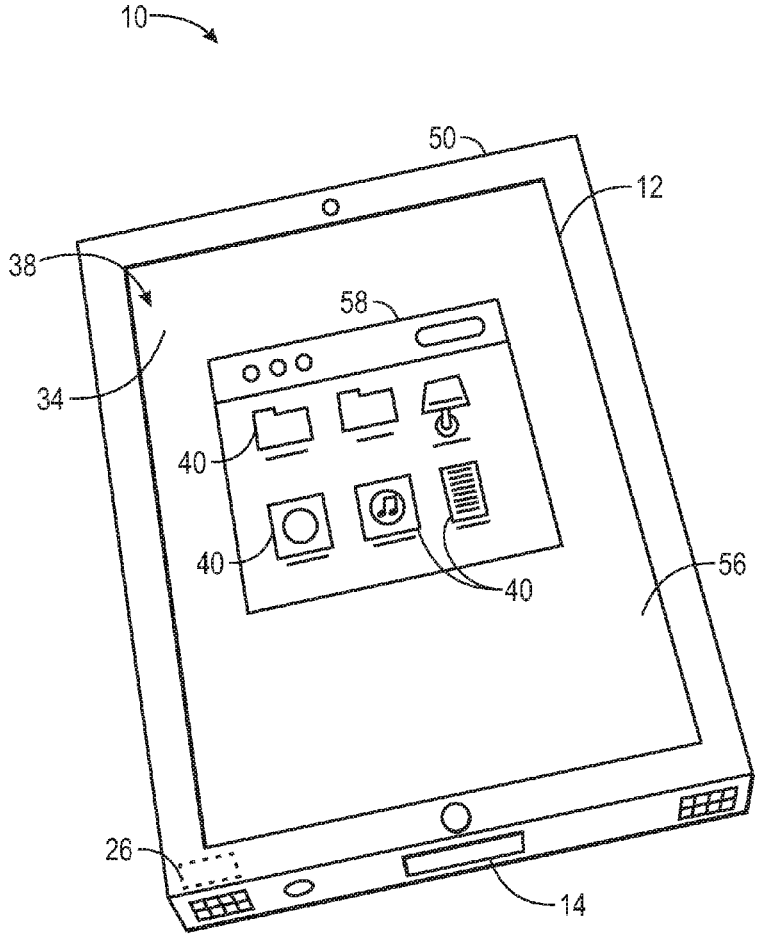
FIG. 4 is a perspective view of a tablet-style electronic device that may be used in conjunction with aspects of the present disclosure.

With these foregoing features in mind, a general description of suitable electronic devices for performing these functions is provided below with respect to FIGS. 1-4. Specifically, FIG. 1 is a block diagram depicting various components that may be present in electronic devices suitable for use with the present techniques. FIG. 2 depicts an example of a suitable electronic device in the form of a computer. FIG. 3 depicts another example of a suitable electronic device in the form of a handheld portable electronic device. Additionally, FIG. 4 depicts yet another example of a suitable electronic device in the form of a computing device having a tablet-style form factor. These types of electronic devices, and other electronic devices providing comparable display capabilities, may be used in conjunction with the present techniques.

Keeping the above points in mind, FIG. 1 is a block diagram illustrating components that may be present in one such electronic device 10, and which may allow the device 10 to function in accordance with the techniques discussed herein. The various functional blocks shown in FIG. 1 may include hardware elements (including circuitry), software elements (including computer code stored on a computer-readable medium, such as a hard drive or system memory), or a combination of both hardware and software elements. It should be noted that FIG. 1 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

The display 12 may be used to display various screens generated by the electronic device 10. The display may be any suitable display such as a liquid crystal display (LCD), for example. In one embodiment, the display 12 may be an LCD employing fringe field switching (FFS), in-plane switching (IPS), or other techniques useful in operating such LCD devices. The display 12 may be a color display utilizing a plurality of color channels for generating color images. By way of example, the display 12 may utilize a red, green, blue, or white color channel. The display 12 may include a backlight such an organic light emitting diode (OLED). In one embodiment, the OLED backlight may be optically bonded to the LCD of the display 12.

In certain embodiments, the display 12 may include an arrangement of unit pixels defining rows and columns that form a viewable region of the display 12. A source driver circuit may output voltage signals to the display 12 by way of source lines defining each column of the display 12. Each unit pixel may include a thin film transistor (TFT) configured to switch a pixel electrode. When activated, the TFT may store image signals received via a respective data or source line as a charge in the pixel electrode. The image signals stored by the pixel electrode may be used to generate an electrical field between the respective pixel electrode and a common electrode. Such an electrical field may align liquid crystals molecules within an adjacent liquid crystal layer to modulate light transmission through the liquid crystal layer. The light to be transmitted through the liquid crystal layer may be emitted by a backlight device, such as an OLED backlight. As will be discussed further below, in some embodiments, the image signals driven by the source driver circuit may be used by both modulating elements of the LCD, as well as light emitting elements of the backlight, such as an OLED backlight. Furthermore, the control of image signals or other signals driven to the display may be performed by any suitable processor 18 of the system 10, including processors or controllers in the display 12.

In some embodiments, the present techniques may also be applied to displays that utilize multiple common voltage lines. For instance, in one implementation, two or more common voltages may be supplied to respective common voltage lines coupled to respective sets of pixels to define discrete regions within an integrally-formed touch sensing system. For example, a display device may utilize two or more common voltages to provide touch sensing functions, and the LCD and the OLED backlight may change a displayed screen in response to such touch sensing functions.

Such a touch sensing system may be provided in conjunction with the display 12 and may be commonly referred to as a touchscreen. The touchscreen may be used as part of a control interface for the device 10. In such embodiments, the touchscreen may be formed integrally with the display 12 as one of the input structures 16. For instance, certain capacitive elements forming the pixels of the display 12 may dually function as pixel storage capacitors or as capacitive elements of a touch sensing system for detecting touch inputs. In this manner, a user may interact with the device by touching the display 12, such as with the user's finger or a stylus. In response to the touchscreen interaction, a suitable processor (e.g., processor(s) 18) or display controller may control the image signals driven to the LCD active matrix and/or the OLED elements to control the displayed image.

FIG. 2 illustrates an embodiment of the electronic device 10 in the form of a computer 30. The computer 30 may include computers that are generally portable (such as laptop, notebook, tablet, and handheld computers), as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® Mini, or Mac Pro®, available from Apple Inc. of Cupertino, Calif. The depicted computer 30 includes a housing or enclosure 33, the display 12, I/O ports 14, and input structures 16.

The display 12 may be integrated with the computer 30 (e.g., such as the display of a laptop computer) or may be a standalone display that interfaces with the computer 30 using one of the I/O ports 14, such as via a DisplayPort, DVI, High-Definition Multimedia Interface (HDMI), or analog (D-sub) interface. For instance, in certain embodiments, such a standalone display 12 may be a model of an Apple Cinema Display®, available from Apple Inc. As will be discussed below, the display 12 may be an LCD 34 that is backlit by one or more OLED elements.

The electronic device 10 may also take the form of other types of devices, such as mobile telephones, media players, personal data organizers, handheld game platforms, cameras, and/or combinations of such devices. For instance, as generally depicted in FIG. 3, the device 10 may be provided in the form of a handheld electronic device 32 that includes various functionalities (such as the ability to take pictures, make telephone calls, access the Internet, communicate via email, record audio and/or video, listen to music, play games, connect to wireless networks, and so forth). By way of example, the handheld device 32 may be a model of an iPod®, iPod® Touch, or iPhone® available from Apple Inc.

In the depicted embodiment, the handheld device 32 includes the display 12, which may be in the form of an LCD 34. The LCD 34 may display various images generated by the handheld device 32, such as a graphical user interface (GUI) 38 having one or more icons 40. As will be discussed below, backlighting for the LCD 34 may be provided by one or more OLED elements which may each emit light at varying intensities according to the image(s) to be displayed by the LCD 34.

In another embodiment, the electronic device 10 may also be provided in the form of a portable multi-function tablet computing device 50, as depicted in FIG. 4. In certain embodiments, the tablet computing device 50 may provide the functionality of one or more of a media player, a web browser, a cellular phone, a gaming platform, a personal data organizer, and so forth. By way of example only, the tablet computing device 50 may be a model of an iPad® tablet computer, available from Apple Inc.

The tablet device 50 includes the display 12 in the form of an LCD 34 that may be used to display GUI 38. The LCD 34 may include an OLED backlight, and in one embodiment, the OLED backlight may be optically bonded to the active matrix of the LCD 34. The GUI 38 may include graphical elements that represent applications and functions of the tablet device 50. For instance, the GUI 38 may include various layers, windows 58, screens, templates, or other graphical elements that may be displayed in all, or a portion, of the display 12. As shown in FIG. 4, the LCD 34 may include a touch-sensing system 56 (e.g., a touchscreen) that allows a user to interact with the tablet device 50 and the GUI 38. By way of example only, the operating system GUI 38 displayed in FIG. 4 may be from a version of the Mac OS® (e.g., OS X) operating system, available from Apple Inc.

With the foregoing discussion in mind, it may be appreciated that an electronic device 10 in the form of a computer 30, a handheld device 32, or a tablet device 50, may be provided with an LCD 34 as the display 12. Such an LCD 34 may be utilized to display the respective operating system and application interfaces running on the electronic device 10 and/or to display data, images, or other visual outputs associated with an operation of the electronic device 10.

In embodiments in which the electronic device 10 includes an LCD 34, the LCD 34 may include an array or matrix of picture elements (i.e., pixels). In operation, the LCD 34 generally operates to modulate the transmission of light through the pixels by controlling the orientation of liquid crystal disposed at each pixel. In general, the orientation of the liquid crystals is controlled by a varying an electric field associated with each respective pixel, with the liquid crystals being oriented at any given instant by the properties (strength, shape, and so forth) of the electric field. The light to be modulated by and/or transmitted through each pixel may be emitted by an OLED element, as will be discussed.

Different types of LCDs may employ different techniques in manipulating these electrical fields and/or the liquid crystals. For example, certain LCDs employ transverse electric field modes in which the liquid crystals are oriented by applying an in-plane electrical field to a layer of the liquid crystals. Example of such techniques include in-plane switching (IPS) and fringe field switching (FFS) techniques, which differ in the electrode arrangement employed to generate the respective electrical fields.

While control of the orientation of the liquid crystals in such displays may be sufficient to modulate the amount of light emitted by a pixel, color filters may also be associated with the pixels to allow specific colors of light to be emitted by each pixel. For example, in embodiments where the LCD 34 is a color display, each pixel of a group of pixels may correspond to a different primary color. For example, in one embodiment, a group of pixels may include a red pixel, a green pixel, and a blue pixel, each associated with an appropriately colored filter. The intensity of light allowed to pass through each pixel (by modulation of the corresponding liquid crystals), and its combination with the light emitted from other adjacent pixels, determines what color(s) are perceived by a user viewing the display. As the viewable colors are formed from individual color components (e.g., red, green, and blue) provided by the colored pixels, the colored pixels may also be referred to as unit pixels.

Figure 5:
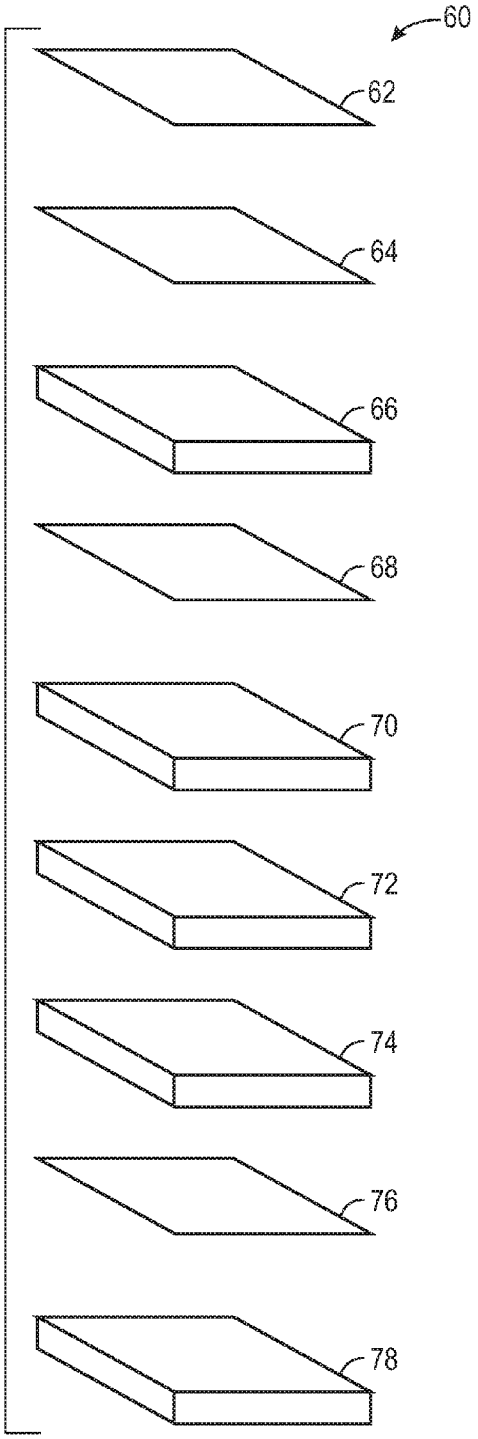
FIG. 5 is an exploded view of layers of a pixel of a liquid crystal display (LCD) panel, in accordance with aspects of the present disclosure.

With the foregoing in mind, and turning once again to the figures, FIG. 5 depicts an exploded view of different layers of a pixel of a display 12. The pixel 60 includes an upper polarizing layer 62 and a lower polarizing layer 64 that polarize light emitted by a backlight assembly 70. An upper substrate 66 is disposed below the polarizing layer 64, and a color filter layer 68, a liquid crystal layer 70 and a thin film transistor (TFT) layer 72 may be disposed between the upper substrate 66 and a lower substrate 74. The upper and lower substrates 66 and 74 may be formed from a light-transparent material, such as glass, quartz, and/or plastic. The back side of the lower substrate 74 may be bonded to a backlight assembly 78 using an optically clear adhesive layer 76, in one embodiment. The TFT layer 72 and the backlight assembly 78 may be simplified in FIG. 5 as single layers. However, each of the TFT layer 72 and the backlight assembly 78 may include a number of structures and layers, which are discussed in detail with respect to FIGS. 7 and 8. As such, FIGS. 5-7 may be discussed concurrently.

Figure 6:
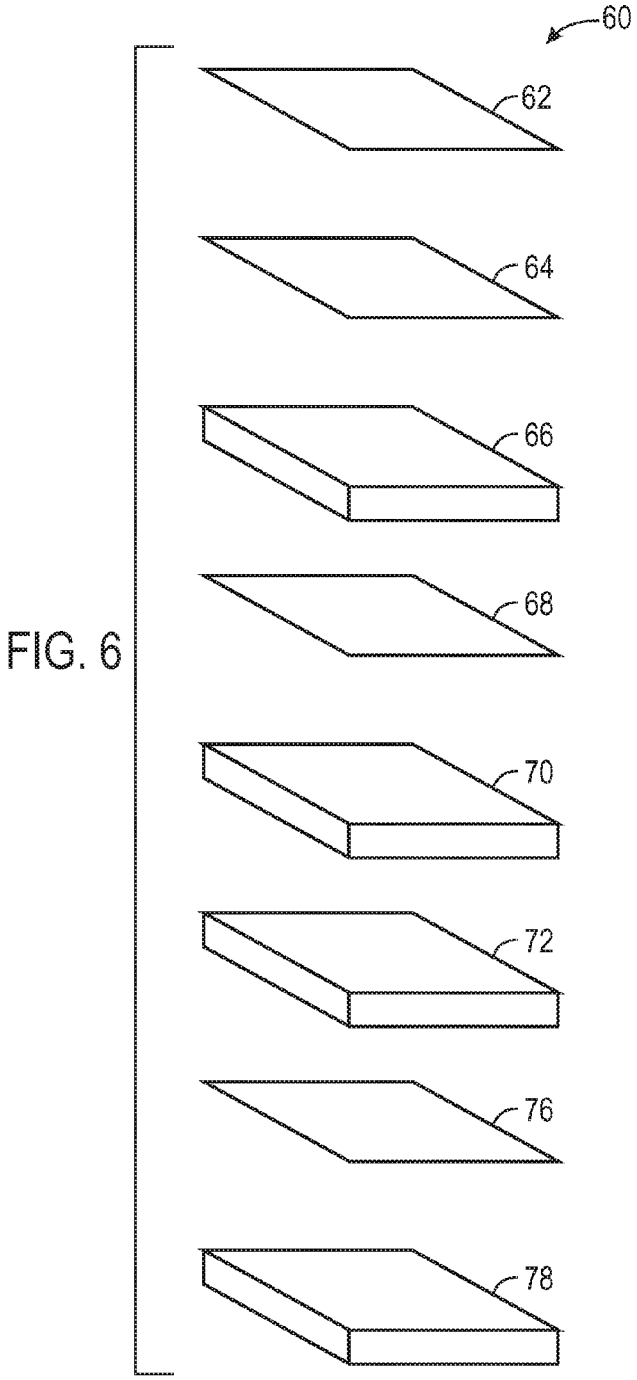
FIG. 6 is another exploded view of layers of a pixel of a liquid crystal display (LCD) panel, in accordance with aspects of the present disclosure.

Furthermore, the described layers of the pixel 60 are only examples of materials which may construct an LCD display device using an OLED backlight. In some embodiments, not all illustrated layers may be present, and/or additional layers may be utilized. For example, in one embodiment of a pixel as illustrated in FIG. 6, a layer of glass between the LCD portion of the pixel 60 and the backlight portion of the pixel 60 may be eliminated. As illustrated in FIG. 6, the lower substrate 74 may be eliminated such that the backlight assembly 78 may be directly bonded by the optically clear adhesive layer 76 to the TFT layer 72. Alternatively, a top layer of glass of the backlight assembly 78 may be eliminated, and the backlight assembly may be directly bonded to the lower substrate 74 of the LCD portion of the pixel.

Referring to either FIG. 5 or 6, the TFT layer 72 may comprise various conductive, non-conductive, and semiconductive layers and structures which generally form the electrical devices and pathways which drive operation of the pixel 60. For example, in an embodiment in which the pixel 60 is part of an FFS LCD panel, the TFT layer 72 may include the respective data lines, scanning or gate lines, pixel electrodes, and common electrodes (as well as other conductive traces and structures) of the pixel 60. Such conductive structures may, in light-transmissive portions of the pixel, be formed using transparent conductive materials, such as indium tin oxide (ITO). In addition, the TFT layer 72 may include insulating layers (such as a gate insulating film) formed from suitable transparent materials (such as silicon oxide) and semiconductive layers formed from suitable semiconductor materials (such as amorphous silicon). In general, the respective conductive structures and traces, insulating structures, and semiconductor structures may be suitably disposed to form the respective pixel and common electrodes, a TFT, and the respective data and scanning lines used to operate the pixel 60. The TFT layer 72 may also include an alignment layer (not illustrated) formed from polyimide or other suitable materials at the interface with the liquid crystal layer 70.

Figure 7:
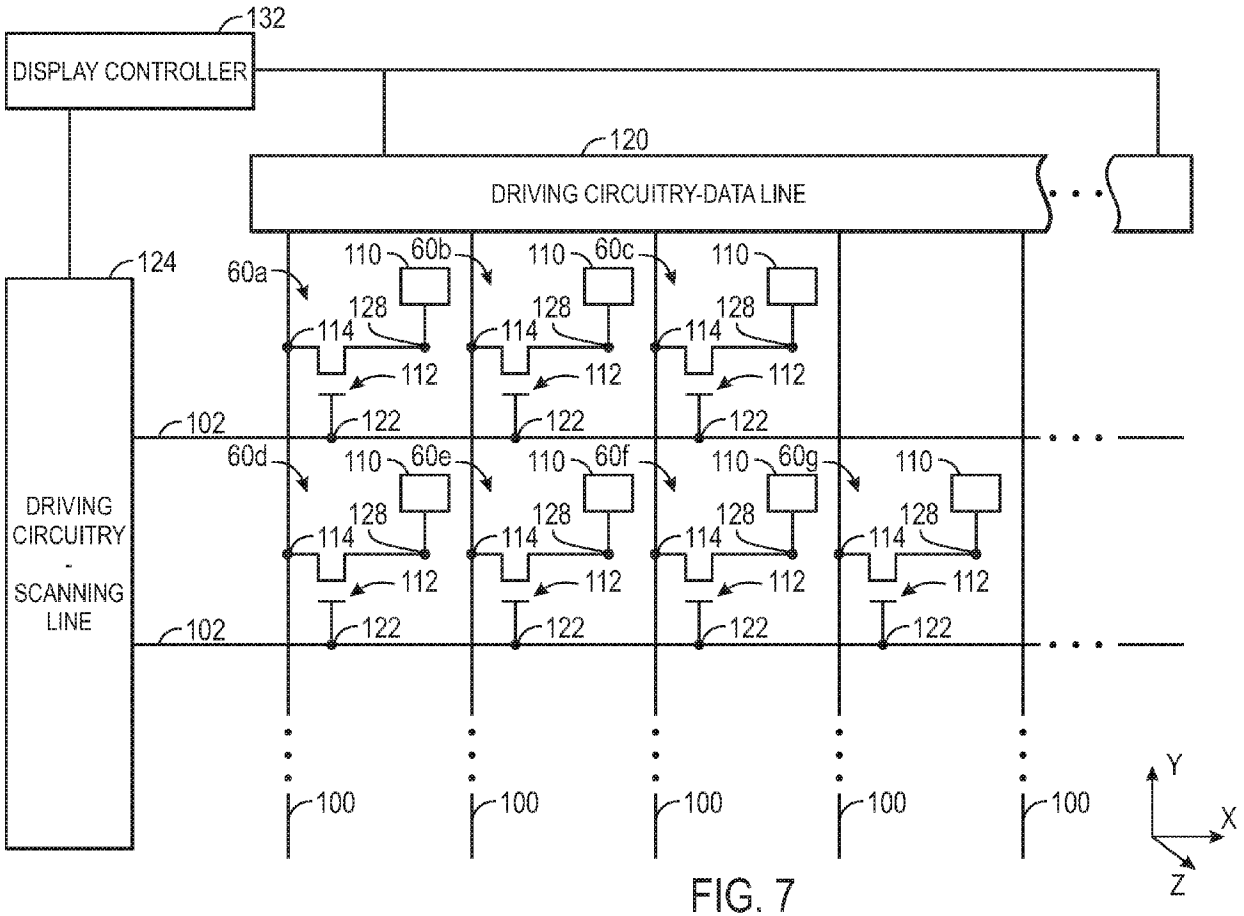
FIG. 7 is a circuit diagram of switching and display circuitry of LCD pixels, in accordance with aspects of the present disclosure.

FIG. 7 provides an example of a circuit view of pixel driving circuitry found in an LCD 34. For example, such circuitry as depicted in FIG. 7 may be embodied in the TFT layer 72 described with respect to FIG. 5 or 6. As depicted, the pixels 60 may be disposed in a matrix that forms an image display region of an LCD 34. In such a matrix, each pixel 60 may be defined by the intersection of data lines 100 and scanning or gate lines 102. The matrix of pixels 60 in the TFT layer 72 may also be referred to as the active matrix of the LCD 34, and the portion of the pixels 60 defined by the TFT layer 72 may also be referred to as active matrix pixels 60.

Although only seven unit pixels, referred to individually by the reference numbers 60*a*-60*g*, respectively, are shown in the present example for purposes of simplicity, it should be understood that in an actual LCD implementation, each data line 100 and scanning line 102 may include hundreds or even thousands of unit pixels to form LCD 34 devices having any combination of display resolutions (e.g., 1024×768, 960×640, etc.) and screen sizes. By way of example, in a color LCD panel 34 having a display resolution of 960×640, each data line 100, which may define a column of the pixel array, may include 640 unit pixels, while each scanning line 102, which may define a row of the pixel array, may include 960 groups of pixels, wherein each group has a red, blue, and green pixel, thus totaling 2886 unit pixels per scanning line 102.

In the present illustration, the group of unit pixels 60*a*-60*c* may represent a group of pixels having a red pixel (60*a*), a blue pixel (60*b*), and a green pixel (60*c*). A group of pixels (e.g., a red pixel 60*a*, a blue pixel 60*b*, and a green pixel (60*c*) may generally be referred to as a pixel 60 or an RGB pixel 60. In some embodiments, the color of each pixel 60 may be determined by the alignment of the light modulating portion of the pixel 60 with the color filter layer 68 (FIG. 5 or 6). The intensity of light allowed to transmit through each of the red pixel 60*a*, the blue pixel 60*b*, and the green pixel 60*c* and the corresponding color of the color filter layer 68, and its combination with the light emitted from other adjacent pixels, determines what color(s) are perceived by a user viewing the display.

Furthermore, in some embodiments, a white pixel may also be used. For example, the group of unit pixels 60*d*-60*g* may represent a group of pixels having a red pixel (60*d*), a blue pixel (60*e*), a green pixel (60*f*), and a white pixel (60*g*), and may generally be referred to as a pixel 60 or an RGBW pixel 60. In some embodiments, the white unit pixel 60*g* may be individually activated to display white (e.g., unfiltered) light. Though the RGB and RGBW pixels 60 are illustrated as having a strip configuration, the configuration of unit pixels 60 forming a pixel 60 may have different configurations. For example, an RGBW pixel 60 may have quadrants of each a red, blue, green, and white pixel. In embodiments, the display 12 may include a matrix of RGB pixels 60 or RGBW pixels 60, or combinations of RGB and RGBW pixels.

The color filter layer 68 may be in a strip arrangement, for example, having adjacent filters which are red, green, and blue in color. In embodiments using an RGBW pixel configuration, the color filter layer 68 arrangement may also include an unfiltered or clear region to transmit light modulated by the white pixel 60*g*. For example, the white unit pixel 60*g* may be activated to transmit light white (e.g., unfiltered by the color filter layer 68) emitted by the OLED backlight 78. In one embodiment, the color filter 68 may be surrounded by a light-opaque mask or matrix, e.g., a black mask which circumscribes the light-transmissive portion of the pixel 60. In other embodiments, the black mask may be eliminated from the configuration of the pixel 60 entirely (e.g., eliminated from the color filter and from a typical placement in the backlight). Rather, in such embodiments where no black masks are used in the pixel, a black layer may be implemented behind the entire LCD panel 34.

Referring back to FIG. 7, each pixel 60 includes a pixel electrode 110 and thin film transistor (TFT) 112 for switching the pixel electrode 110. In the depicted embodiment, the source 114 of each TFT 112 is electrically connected to a data line 100, extending from respective data line driving circuitry 120. Similarly, in the depicted embodiment, the gate 122 of each TFT 112 is electrically connected to a scanning or gate line 102, extending from respective scanning line driving circuitry 124. In the depicted embodiment, the pixel electrode 110 is electrically connected to a drain 128 of the respective TFT 112.

In one embodiment, the data line driving circuitry 120 sends image signals to the pixels via the respective data lines 100. Such image signals may be applied by line-sequence, i.e., the data lines 100 may be sequentially activated during operation. The scanning lines 102 may apply scanning signals from the scanning line driving circuitry 124 to the gate 122 of each TFT 112 to which the respective scanning lines 102 connect. Such scanning signals may be applied by line-sequence with a predetermined timing and/or in a pulsed manner. The data line driving circuitry 120 and/or the scanning line driving circuitry 124 may be controlled by a display controller 132. For example, the display controller 132 may transmit data and/or clock signals via a synchronous bus to the data line driving circuitry 120, and the data line driving circuitry 120 may latch data and drive the resulting image signals through the data lines 100 to the TFTs 112 of the pixels 60.

Each TFT 112 serves as a switching element which may be activated and deactivated (i.e., turned on and off) for a predetermined period based on the respective presence or absence of a scanning signal at the gate 122 of the TFT 112. When activated, a TFT 112 may store the image signals received via a respective data line 100 as a charge in the pixel electrode 110 with a predetermined timing.

The image signals stored at the pixel electrode 110 may be used to generate an electrical field between the respective pixel electrode 110 and a common electrode. In some embodiments, a storage capacitor may also be provided in parallel to the liquid crystal capacitor formed between the pixel electrode 110 and the common electrode to prevent leakage of the stored image signal at the pixel electrode 110. For example, such a storage capacitor may be provided between the drain 128 of the respective TFT 112 and a separate capacitor line.

The electric field generated between the pixel electrode 110 and the common electrode of a pixel may be applied to the liquid crystal layer 70 (FIG. 5 or 6) of the respective pixel 60. The liquid crystal layer 70 may include liquid crystal particles or molecules suspended in a fluid or gel matrix. The liquid crystal particles or molecules may be oriented or aligned with respect to generated electrical field (e.g., based on the shape, strength, etc. of the electrical field). The orientation or alignment of the liquid crystal particles in the liquid crystal layer 70 determines the amount of light which may be transmitted through the pixel 60. For example, the liquid crystal particles may be oriented (e.g., parallel to the layer 70) to substantially block light or oriented (e.g., perpendicular to the layer 70) to substantially transmit light, or oriented to transmit any percentage of light between fully blocking and fully transmitting. As will be further discussed with respect to FIG. 8, the light which may be transmitted through the pixel 60 may be emitted by a backlight 78 (FIG. 5) associated with the LCD panel 34. Thus, by modulation of the electrical field applied to the liquid crystal layer 70, the amount of light emitted by the backlight 78 and transmitted though the pixel 60 may be correspondingly modulated. As the liquid crystal layer 70 and the TFT layer 72 of the pixel 60 may generally modulate light transmission, the layers 70 and 72 may be referred to as the light modulating portion of a pixel 60.

Figure 8:
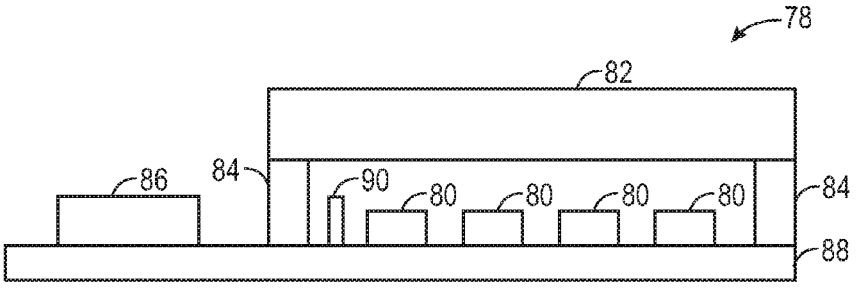
FIG. 8 is a cross-sectional side view of an organic light emitting diode (OLED) backlight of the LCD panel having multiple OLED elements, in accordance with aspects of the present disclosure.

Turning now to FIG. 8 a cross-sectional view of the layers which may be present in a backlight of a particular embodiment are depicted. For example, the layers as depicted in FIG. 8 may be embodied in the backlight assembly 78 described with respect to FIG. 5 or 6. In one embodiment, the backlight assembly 78, such as an OLED backlight, may include a substrate layer 88 (e.g., a glass substrate layer) on which a layer of OLED elements 80 may be formed. Each element 80 may be printed, deposited, or otherwise formed on the substrate layer 88, and may include two electrodes with organic electroluminescent materials between the two electrodes. For example, each OLED element 80 may be an optoelectronic device typically including an anode, a hole-transporting layer made of an organic compound, an organic electroluminescent layer with suitable dopants, an electron transport layer, and a cathode.

The OLED backlight 78 may also include a cover or external layer 82 (e.g., a cover glass) that forms the external viewing surface facing a viewer. In certain embodiments the cover layer 82 may perform various color filtration and/or polarization functions with respect to the light emitted by the OLED elements 80. In one embodiment, the cover layer 82 and the substrate layer 88 may be bonded together, such as by a glass frit bond 84, along all or part of the periphery of the surface and/or substrate layers. Further, in some embodiments, the OLED backlight 78 may include a light sensor 90 (e.g., a photodetector, a photodiode, a photovoltaic sensor, and so forth) which may operate as a pixel-level ambient light sensor. For example, the light sensor may be in the form of a photovoltaic sensor 90 which may generate an electric signal in response to an intensity of light emitted by one or more elements 80. As will be discussed, the light intensity sensed by the light sensor 90 may be used to determine whether and/or when an image signal may be recalibrated. In one implementation, the OLED backlight 78 is between approximately 1.5 mm and 1.9 mm in thickness. In some embodiments, the backlight assembly 78 may be optically bonded with the light modulating components (e.g., the liquid crystal layer 70 and the TFT layer 72) within the LCD 34 by an optically clear adhesive (OCA). For example, the backlight assembly 78 may be bonded to the lower substrate 74. Additionally, in some embodiments, the lower substrate 74 may be eliminated (as illustrated in FIG. 6) or a top glass substrate of the backlight assembly 78 may be eliminated such that the LCD portion of the pixel 60 is directly bonded to the backlight assembly 78.

Each OLED element 80 in the OLED backlight 78 may be activated to emit light by applying a current through the layers of the OLED element 80. The current applied to the OLED element 80, referred to as the emission signal, may flow from one electrode to another (e.g., from the cathode to the anode), and through the organic materials between the two electrodes. The organic electroluminescent materials may emit photons (perceived as light) in response to the emission signal. The light may be emitted through a substantially transparent electrode (e.g., the cathode) to be modulated and/or transmitted through the light modulating portion of the pixel 60. In one embodiment, one or more driver chips 86 (such as a chip-on-glass (COG)) may drive the emission signal (received from a suitable controller or processor(s) 18) to one or more OLED elements 80. In another embodiment, as will be discussed, the emission signal may also be driven by a common driver of the TFT layer 72, such as the data line driving circuitry 120, for example.

Figure 9:
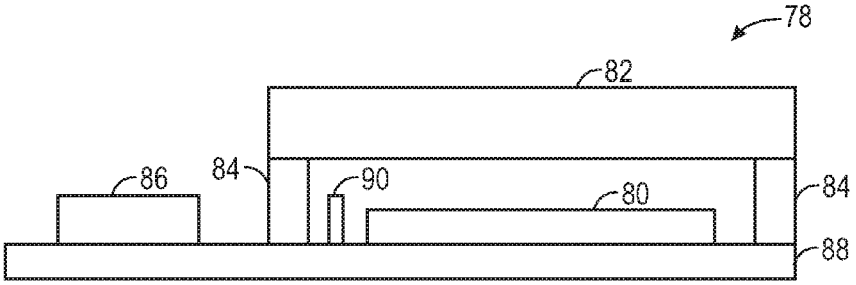
FIG. 9 is a cross-sectional side view of an OLED display of the LCD panel having one OLED element, in accordance with aspects of the present disclosure.

While multiple OLED elements 80 are illustrated in FIG. 8, an LCD panel 34 may use one or a plurality of OLED elements 80 in accordance with the present techniques. For example, as illustrated in FIG. 9, an OLED backlight 78 may have a single OLED element 80 emitting light to be transmitted through the light modulating portion of all the pixels 60 in the LCD 34. The intensity of light emitted by the single OLED element 80 may be controllable based on the operation of the light modulating portion of the pixels 60. For example, an image signal may be driven to the TFTs 112 (FIG. 5 or 6) of the TFTs layer 72 of the pixels 60 to reduce light transmission through the liquid crystal layer 70 of the pixels 60. The grayscale information of the same image signal may be used by the OLED backlight 78 to determine the intensity of light emitted, thus reducing power consumption when a mostly black or a relatively dark image is to be displayed on a corresponding portion of the LCD 34.

In some embodiments, an OLED backlight 78 may have multiple OLED elements 80, and each element 80 may be individually coordinated and/or controlled. For example, the magnitude of the emission signal transmitted to each OLED element 80 may be controllable, and the intensity of light emitted by each element 80 may depend on the magnitude of the emission signal. Further, each element 80 in an array of OLED elements 80 may be activated according to the operation of the active matrix pixel(s) 60 in the TFT layer 72 (FIGS. 5-7) for which the element 80 is providing backlight. In one embodiment, the emission signal transmitted to an element 80 may cause the element 80 to emit light at an intensity which is related to the amount of light to be transmitted by the pixel 60 for which the element is backlighting. For example, an image signal sent to a pixel may result in substantially no light transmission through the liquid crystal layer 70, and a corresponding emission signal may result in substantially no light emission from the OLED element 80. Similarly, an image signal sent to a pixel may result in transmitting only a certain percentage (e.g., 50%) of light through the liquid crystal layer 70, and the emission signal may result in the corresponding element 80 emitting light at a certain intensity (e.g., approximately 50% of a maximum intensity or some other reduced intensity level). Such operations of the OLED element 80 based on the light transmission of the pixel 60 may result in power savings, as no power is used to emit a higher intensity of light from the element 80 which will only be blocked by the light modulating portion of the pixel 60.

Figure 10:
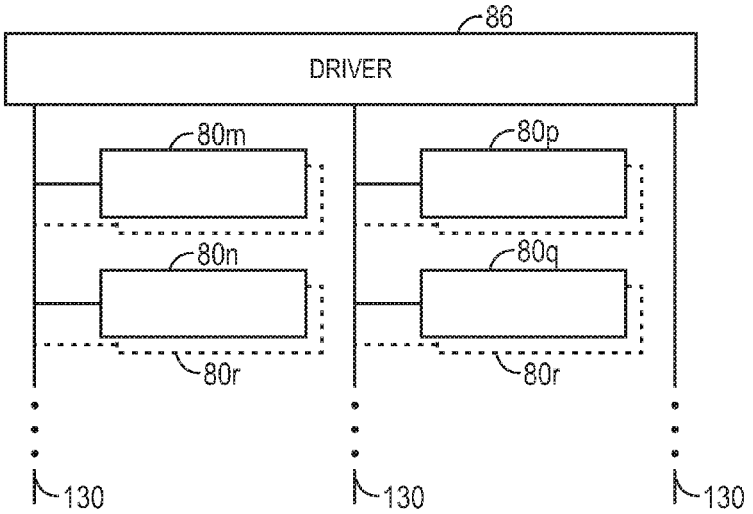
FIG. 10 is a top view of an OLED backlight, in accordance with aspects of the present disclosure.

FIG. 10 depicts an arrangement of OLED elements 80 in an LCD 34 in one embodiment. Each of the elements 80 may emit light to be transmitted through and/or modulated by the light modulating portion of a pixel 60. For example, the element 80*m* may emit light for a pixel 60 (e.g., including the red pixel 60*a*, the blue pixel 60*b*, and the green pixel 60*c* in FIG. 7). For embodiments including a white LCD pixel 60, each element 80 may emit light for the red, blue, green, and white unit pixels 60. For example, the element 80*n* may emit light for the red pixel 60*d*, the blue pixel 60*e*, the green pixel 60*f*, and the white pixel 60*g*. The elements 80*p* and 80*q* may be a backlight for similarly structured pixels (e.g., RGB and/or RGBW pixels 60). Further, in some embodiments, each element 80 may emit light for multiple groups of pixels 60 (e.g., multiple groups of pixels 60*a-c* and/or pixels 60*d-g*).

In one embodiment, emission of light (e.g., the intensity of light to be emitted) from the OLED element 80*n* (FIG. 10) and the amount of light to be transmitted through the light modulating portions of the pixel 60 including unit pixels 60*d-g* (FIG. 7, referred to as pixel 60*d-g*), may be based on a data signal transmitted to the TFTs 112 of pixel 60*d-g* and/or the corresponding element 80. The data signal may be generated by any suitable processor(s) 18 of the system 10, or any controller (e.g., the display controller 132) of the display 12 and may include the image signal directed to the TFTs 112 and the emission signal directed to the elements 80. The image signal may be transmitted to pixel 60*d-g* via data lines 100 from the data line driving circuitry 120, and the emission signal may be transmitted to the OLED element 80*n* via a line 130.

In some embodiments, each element 80 of the OLED backlight 78 may be electrically connected to a respective active matrix pixel 60 in the TFT layer 72. For example, the driver chip 86 may be electrically connected to the display controller 132, or any other suitable controller in the display 12. The display controller 132 may control the transmission of image signals from the data line driving circuitry 120, as well as the transmission of emission signals from one or more drivers 86 of the OLED backlight 78. In some embodiments, a processor(s) 18 of the electronic system 10 (FIG. 1) may communicate with the display controller 132 to determine corresponding emission signals sent to the OLED backlight 34 based on the image signals sent to the active matrix of the LCD 34.

In other embodiments, the driver 86 of the OLED backlight 78 may also be connected to the data line driving circuitry 120. For example, the data line driving circuitry 120 may direct emission signals to be driven by the driver 86 to the elements 80 via the lines 130. Alternatively, the data lines 100 themselves may be connected to the OLED backlight 78. For example, the data line driving circuitry 120 may drive an image signal having information to the red pixel 60*d*, the blue pixel 60*e*, the green pixel 60*f*, and the white pixel 60*g* via data lines 100 in the active matrix and also drive an emission signal via line 130 to the OLED element 80*n*. In such configurations, the lines 130 delivering current to the elements 80 may extend from the data line driving circuitry 120 or from the data lines 100. Further, in some embodiments, a separate driver chip 86 in the OLED backlight 78 may not be necessary, as the data line driving circuitry 120 may drive the emission signal for activating the OLED elements 80.

In some embodiments, more than one OLED element 80 (e.g., two elements 80) may be positioned to backlight each pixel 60 (e.g., pixel 60*a-c* and/or pixel 60*d-g*), such that each of the two elements 80, both smaller than a pixel 60, may be activated differentially over the life of the LCD 34, thus providing wear balancing for the backlight assembly 78. Alternatively, wear balancing may also be implemented by differentially driving two elements 80 which are each larger than the light modulating area of the pixel 60. In another embodiment, wear balancing may be implemented by differentially driving two different layers of OLED elements 80. For example, as depicted by the dotted line outlining element 80*r*, two elements 80 (e.g., element 80*q* and element 80*r*) may be substantially overlapping, and may be on different OLED layers in an OLED backlight 78. The substantially overlapping OLED elements 80 may be driven differentially to provide wear balancing of the backlight 78. Further, in some embodiments, a first element 80 may be activated for a period of time and faded out while another element (e.g., an adjacent element or an element substantially overlapping with the out-fading element 80) may be faded in until it is fully activated. Such wear balancing operations may not be substantially noticeable in a user's experience of a displayed image on the LCD 34.

In some embodiments, the image signals driven to the light modulating portion of the pixel 60 may also change over the life of the LCD 34. For example, characteristics of the OLED backlight 78 may change over time (e.g., emit a lower intensity light in response to the same amplitude current of an emission signal). The image signal transmitted to the active matrix pixels 60 may be calibrated to accommodate for predicted light emission changes of the OLED backlight 78. For example, if elements 80 in the OLED backlight 78 are expected to emit light with degraded intensity, an image signal sent to the active matrix pixels 60 may be adjusted such that more of the (possibly weakened) light emitted from the OLED backlight 78 may be transmitted. For example, a calibrated image signal may generate an electric field at the pixel electrode 110 (FIG. 7) which aligns the crystals in the liquid crystal layer 70 to transmit light at an increased percentage to compensate for a decreased intensity of light emitted by the backlight 78.

In one embodiment, such a calibration may be made by a processor 18 (FIG. 1), by the display controller 132 (FIG. 7) of the display 12 (FIG. 1), or by any other suitable processor in the system 10. Furthermore, such calibrations may be pre-programmed to occur after one or more time intervals of the LCD 34 lifespan, based on predicted degradation or changes in the OLED backlight 78. Calibrations may also be made according to light sensors 90 (FIGS. 8 and 9) which may generate a signal in response to an intensity of light emitted by the OLED backlight 78. In some embodiments, a signal generated by the light sensor 90 may be transmitted to a suitable processor or controller (e.g., processor 18 or controller 132, for example) to determine when to recalibrate the image signals sent to the LCD active matrix pixels 60. For example, the light sensor 90 may measure the intensity of light emitted by an element 80 and the controller 132 may recalibrate the image signals based on the measured light intensity.

In some embodiments, the generated signal may be directly utilized by the elements 80 of the backlight 78 to affect an intensity of light emitted by the elements 80. For example, a photovoltaic sensor 90 may be connected in series to a diode gate of one or more elements 80 such that an element 80 may transmit light at an increased (or reduced) intensity in response to the ambient light sensed by the sensor 90. Thus, the intensity of light emitted by the elements 80 may also be adjustable. Further, the closed-loop system between the light sensors 90 and the elements 80 may result in power reduction.

Recalibration of image signals and/or readjusting the intensity of light emitted by the elements 80 based on a light sensed by the light sensor 90 may also be used to decrease the negative affects of glare or uneven lighting on the surface of the LCD 34. For example, a photovoltaic sensor 90 may sense ambient light which may obstruct the viewing of the displayed image. The photovoltaic sensor 90 may generate a signal in response to detected light to recalibrate image signals and/or readjust the intensity of light emitted by the elements 80. Furthermore, as the photovoltaic sensor 90 may control an individual unit pixel 60 (or groups of pixels 60), uneven lighting may be addressed by recalibrating and/or readjusting light transmission and/or emission for only the affected pixels 60.

Furthermore, embodiments of an LCD 34 having an OLED backlight 78 also include touch sensing mechanisms (e.g., touchscreen). The touchscreen may be formed integrally with the LCD 34 having an OLED backlight 78. For example, a user may interact with interface elements of the LCD 34 by touching the display, which may generate electrical signals indicative of the user's touch input. Such touch input signals may be stored in the LCD 34, in capacitive elements of the pixel 60, for example. Touch input signals may be routed via suitable pathways (e.g., an input bus) to be processed by a processor(s) 18. The images displayed by the LCD 34 may then change based on the touch input signals. For example, the user may interact with the touchscreen to display a different image on the LCD 34. Based on the user's touch input and the processing of the touch input signal, the processor(s) 18 may direct the display controller 132 to transmit data signals to display the desired screen. For example, an emission signal may be sent to activate OLED elements 80 of the OLED backlight 78, and an image signal may be sent to the active matrix pixels 60. Each OLED element 80 may emit an intensity of light corresponding to the image signals sent to the active matrix pixels 60.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A liquid crystal display (LCD) device, comprising:

an organic light emitting diode (OLED) device comprising a plurality of elements disposed between a substrate layer and a cover layer, and a bond disposed about a periphery of the OLED device, wherein the plurality of elements is configured to receive an emission signal generated by a processor and emit light at an intensity based on the emission signal;

an optically clear adhesive layer comprising a first face and an opposing second face, wherein the first face is optically bonded to the OLED device; and an active matrix comprising a plurality of active matrix pixels formed in a TFT layer, wherein the plurality of active matrix pixels is configured to receive an image signal generated by the processor and to modulate the transmission of the emitted light based on the image signal, wherein the TFT layer with the active matrix is optically bonded to the second face of the optically clear adhesive layer, the TFT layer is directly bonded to the OLED device via the optically clear adhesive layer, and wherein each of the plurality of active matrix pixels is configured to modulate the transmission of the emitted light from at least one respective element of the plurality of elements.

2. The LCD device of claim 1, wherein each of the plurality of active matrix pixels is configured to modulate the transmission of the emitted light from a corresponding one of the plurality of elements, and wherein each of the plurality of active matrix pixels comprise a red pixel, a blue pixel, and a green pixel.

3. The LCD device of claim 1, wherein the active matrix is configured to modulate the transmission between substantially blocking the emitted light and substantially transmitting the emitted light, and wherein the intensity of the emitted light is low when the active matrix is substantially blocking, relative to the intensity of the emitted light when the active matrix is substantially transmitting.

4. The LCD device of claim 1, wherein the intensity of the emitted light is based at least in part on the image signal.

5. The LCD device of claim 1, wherein each of the plurality of active matrix pixels is configured to modulate the transmission of the emitted light from a corresponding pair of the plurality of elements, wherein each of the plurality of active matrix pixels comprise a red pixel, a blue pixel, and a green pixel, and wherein each element of the pair of the plurality of elements is differentially driven based on wear considerations.

6. The LCD device of claim 1, wherein the LCD device comprises a touchscreen integrally formed with the active matrix, wherein the touchscreen is configured to respond to a user touch, and wherein the OLED device is configured to emit light at an intensity based on the user touch, and wherein the active matrix is configured to modulate the transmission of the emitted light based on the user touch.

7. The LCD device of claim 1, wherein the image signal is calibrated based on the intensity of the emitted light.

8. The LCD device of claim 1, wherein the processor is configured to generate a data signal comprising the image signal and the emission signal, wherein the image signal is addressed to the plurality of active matrix pixels, and wherein the emission signal is addressed to the plurality of elements.

9. The LCD device of claim 1, comprising a black layer disposed behind the LCD device.

10. An electronic device, comprising:

a touchscreen integrally formed with a light modulating layer, wherein the touchscreen is configured to receive a touch input and is configured to change a displayed screen on the electronic device in response to the touch input;

a processor configured to generate an image signal and an emission signal based on the touch input;

an organic light emitting diode (OLED) backlight configured to emit light based on the emission signal;

the light modulating layer configured to modulate the transmission of the emitted light based on the image signal, wherein the light modulating layer comprises a thin film transistor (TFT) layer; and an optically clear adhesive layer optically bonded to the OLED backlight and to the TFT layer of the light modulating layer, wherein the OLED backlight is directly bonded to the TFT layer via the optically clear adhesive layer.

11. The display device of claim 10, wherein the light modulating layer comprises a liquid crystal layer, wherein the TFT layer is configured to generate an electric field based on the image signal and the liquid crystal layer is configured to transmit a range of the emitted light based on the electric field.

12. The display device of claim 10, wherein the OLED backlight comprises one OLED element.

13. The display device of claim 10, wherein the OLED backlight comprises a plurality of OLED elements and the light modulating layer comprises a plurality of pixels, wherein each of the pixels is configured to modulate the transmission of the emitted light from each of the plurality of elements.

14. The display device of claim 10, wherein the OLED backlight comprises a plurality of OLED elements and the light modulating layer comprises a plurality of pixels, wherein each of the pixels is configured to modulate the transmission of the emitted light from an element pair of the plurality of OLED elements, and wherein each OLED element of the element pair is alternately activated.

15. The display device of claim 10, wherein the processor is configured to generate a data signal comprising the image signal and the emission signal, wherein the image signal is addressed to the light modulating layer, and wherein the emission signal is addressed to the OLED backlight.

16. The display device of claim 10, wherein the emission signal results in the OLED backlight emitting light at an intensity corresponding to the transmission of light based on the image signal.

17. An electronic system, comprising:

a processor configured to generate a data signal comprising an image signal and an emission signal; and a display comprising:

a backlight assembly comprising a plurality of organic light emitting diode (OLED) elements configured to emit light at an intensity according to the emission signal; and a light modulating layer optically bonded to the backlight assembly, wherein the light modulating layer comprises a thin film transistor (TFT) layer directly bonded with the backlight assembly, the light modulating layer comprises a plurality of light modulating pixels configured to transmit the emitted light at a transmission percentage according to the image signal, and each of the plurality of OLED elements is electrically connected to a respective one of the plurality of light modulating pixels.

18. The electronic system of claim 17, comprising a bus configured to transmit the data signal to the connection between each of the plurality of OLED elements and the respective one of the plurality of light modulating pixels, wherein the emission signal is addressed to each of the plurality of OLED elements and the image signal is addressed to the respective one of the plurality of light modulating pixels.

19. The electronic system of claim 17, comprising a sensor configured to measure an intensity of light emitted by the plurality of OLED elements, wherein the processor is configured to determine an intensity ratio of the measured light intensity relative to the emission signal and configured to calibrate the image signal based on the emission signal and the intensity ratio.

20. The electronic system of claim 19, wherein the processor is configured to generate an image signal such that the light modulating layer transmits the emitted light at an increased transmission percentage, wherein the increased transmission percentage is inversely related to a decrease between the determined intensity ratio and a threshold intensity ratio.

21. The electronic system of claim 17, comprising a touchscreen configured to respond to a user touch, and wherein the backlight assembly is configured to emit light at an intensity based on the user touch, and wherein the light modulating layer is configured to modulate the transmission of the emitted light based on the user touch.

22. The electronic system of claim 17, comprising a light sensor configured to generate a sensor signal in response to sensed ambient light, wherein the OLED elements are configured to emit light at an intensity according to the sensor signal.

23. The electronic system of claim 22, wherein the light sensor is a photovoltaic sensor coupled in series with a diode gate of the OLED element.

* * * * *